United States Patent [19]

Hanlet

[11] Patent Number: 4,609,850

[45] **Date of Patent: * Sep. 2, 1986**

[54] CURRENT DRIVEN GAIN CONTROLLED ELECTRONIC BALLAST SYSTEM

[75] Inventor: Jacques M. Hanlet, Loxahatchee, Fla.

[73] Assignee: Intent Patents A.G., Liechtenstein

[ * ] Notice: The portion of the term of this patent subsequent to Mar. 5, 2002 has been disclaimed.

[21] Appl. No.: 573,769

[22] Filed: Jan. 27, 1984

Related U.S. Application Data

[63] Continuation-in-part of Ser. No. 500,147, Jun. 1, 1983, Pat. No. 4,503,362.

[51] Int. Cl.[4] ..... H05B 41/24; H05B 41/36

[52] U.S. Cl. ..... 315/219; 315/221; 315/223; 315/224; 363/23

[58] Field of Search ..... 315/219, 223, 221, 224, 315/290, 206; 363/23, 25, 40

[56] References Cited

U.S. PATENT DOCUMENTS 3,038,134 6/1962 Forssell ..... 363/40 X
4,127,795 11/1978 Knoll ..... 315/209 R X
4,344,122 8/1982 Jones ..... 363/23
4,414,491 11/1983 Elliott ..... 315/219 X
4,503,362 3/1985 Hanlet ..... 315/221

*Primary Examiner*—David K. Moore
*Assistant Examiner*—Vincent DeLuca

[57] ABSTRACT

A current driven gain controlled electronic ballast system (100) is provided having a power source (112) for actuating a pair of gas discharge tubes (140 and 140'). The ballast system (100) includes a filter network (111) which is connected to the power source (112) for establishing a substantially constant voltage signal and suppressing harmonic frequencies generated by the electronic ballast system (100). An induction circuit (115) is coupled to the filter network (111) for generating a voltage across the gas discharge tubes (140 and 140') responsive to the driving current. The induction circuit (115) includes an automatic gain control network (117) to maintain the driving current at a predetermined value and includes a trigger network (117) for generating a switching signal. A switching circuit (113) is coupled to the induction circuit (115) for establishing the driving current at a substantially constant and predetermined frequency responsive to the switching signal established by the trigger circuit (117).

27 Claims, 1 Drawing Figure

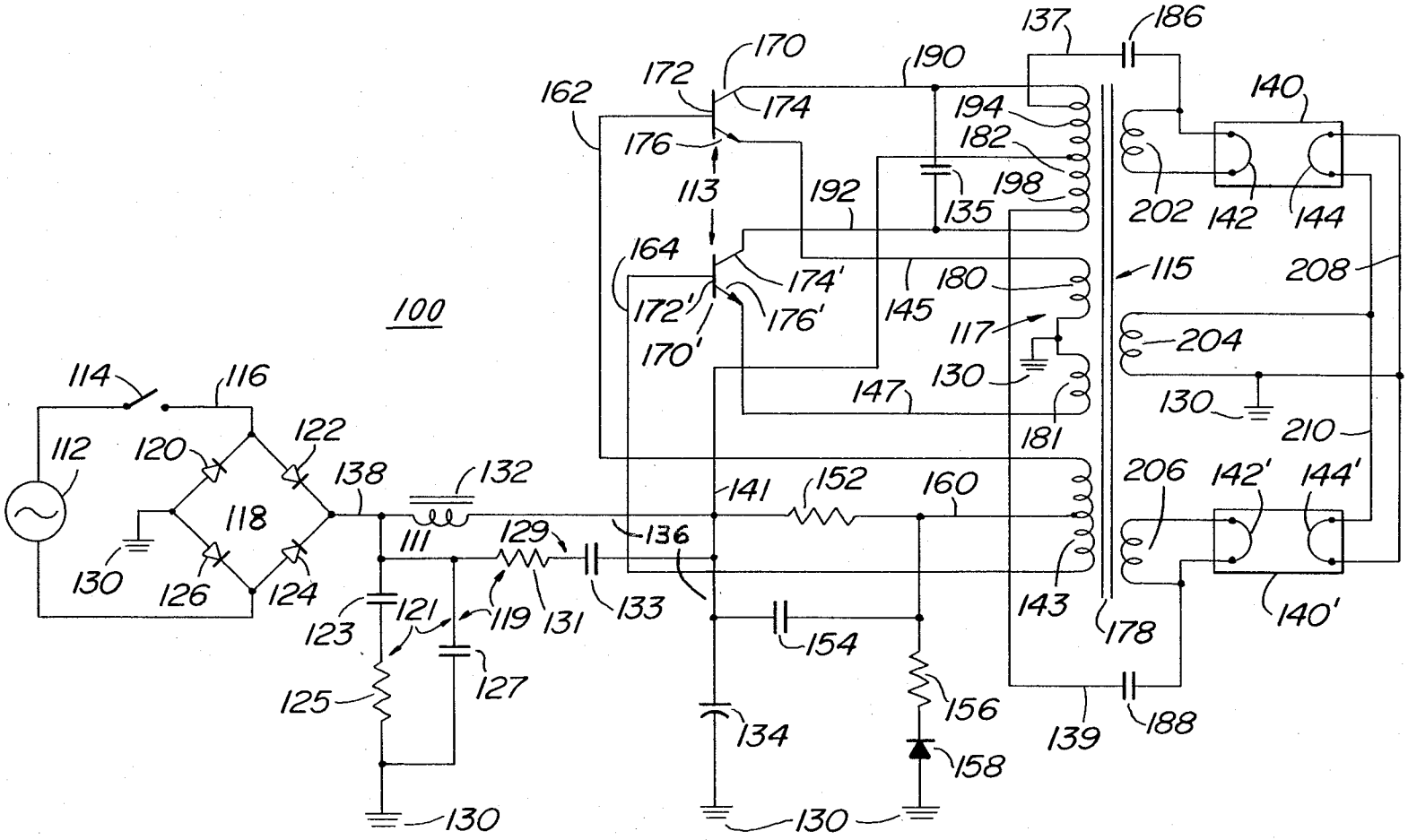
100
112
114
116
118
120
122
124
126
130
132
133
134
135
136
137
138
139
140
140'
141
142
142'
143
144
144'
145
147
152
154
156
158
160
162
164
170
170'
172
172'
174
174'
176
176'
178
180
181
182
186
188
190
192
194
198
202
204
206
208
210
111
113
115
117
119
121
123
125
127
129
131

CURRENT DRIVEN GAIN CONTROLLED ELECTRONIC BALLAST SYSTEM

REFERENCES TO RELATED APPLICATIONS

This invention is a continuation-in-part of U.S. patent application Ser. No. #500,147, having a filing date of June 1, 1983, entitled "FREQUENCY STABILIZED AUTOMATIC GAIN CONTROLLED BALLAST SYSTEM" now U.S. Pat. No. 4,503,362.

BACKGROUND OF THE INVENTION

1. Field of the Invention

This invention is directed to electronic ballast systems for gas discharge tubes. In particular, this invention is directed to automatic gain control ballast systems for fluorescent tubes. In particular, this invention is related to electronic ballast systems which are current driven and provide for automatic gain control. More in particular, this invention relates to a ballast system which provides for a frequency control mechanism utilizing inductance characteristics of an inverter transformer to allow for substantial frequency stabilization. Still further, this invention directs itself to an electronic ballast system for fluorescent light tubes which maximizes the operating lifetime of the fluorescent tubes while maintaining a circuit simplicity with a minimum number of electrical components contained within the ballast system circuit.

2. Prior Art

Electronic ballast systems for gas discharge tubes are known in the art. However, in some prior art electronic ballast systems, there is no provision made for frequency stabilization of the circuit. Thus, in such prior art electronic ballast systems, when a gas discharge tube is removed from the circuit, there is a deleterious flickering of the remaining gas discharge tubes, or in some cases, a complete breakdown of the visible light from the remaining gas discharge tubes.

In other prior art electronic ballast systems, a large number of electrical components are utilized to maintain the gas discharge tubes in operation. However, such large numbers of electrical components increase the manufacturing costs of the prior art electronic ballast systems and further reduce the reliability of such ballast systems.

In other prior art electronic ballast systems, unwanted effects are caused by the amplitude of a multiplicity of harmonic frequencies coupled into the DC supply of such prior art systems. In such prior art electronic ballast systems, correction circuits are not provided to reduce such harmonic frequencies which causes disadvantageous voltage signals applied to the ballast circuitry. In other prior art electronic ballast systems, a saturating transformer is driven by the magnitude of a feedback voltage. In such prior art electronic ballast systems, the oscillation frequency is highly dependent on the supply voltage and thus, where voltage surges are produced, there is a non-constant light output from the gas discharge tubes and variations in the supply voltage may also cause flickering.

In other prior art electronic ballast systems, inverter transformer secondary windings are wound in opposing directions with respect to the primary winding. Thus, in such prior art electronic ballast systems, the inverter transformers are more difficult to manufacture, and therefore more costly and less reliable.

SUMMARY OF THE INVENTION

A current driven gain controlled electronic ballast system having a power source for actuating at least one gas discharge tube. The ballast system includes a filter network connected to the power source for establishing a substantially constant voltage signal and suppressing harmonic frequencies generated by the electronic ballast system. An induction circuit is coupled to the filter network for generating a voltage across the gas discharge tube responsive to the driving current. The induction network includes an automatic gain control circuit for maintaining the driving current at a predetermined value, and further includes trigger circuit for generating a switching signal. A switching network is coupled to the induction circuit for establishing a driving current at a substantially constant and predetermined frequency responsive to the switching signal established by the trigger network.

BRIEF DESCRIPTION OF THE DRAWINGS

The FIGURE is an electrical schematic drawing of the current driven gain controlled electronic ballast system.

DESCRIPTION OF THE PREFERRED EMBODIMENTS

Referring now to the schematic FIGURE, there is shown current driven automatic gain controlled ballast system 100 having power source 112 for actuation of at least one of a pair of gas discharge tubes 140 and 140'. Gas discharge tubes 140 and 140' may be standard fluorescent type systems having first and second filaments 142, 144, and 142', 144', as is shown.

For purposes of illustration and to provide a clear description, power source 112 will be in following paragraphs designated as a 210–240 volt, 50 Hz. AC power source for the embodiments herein described with the understanding that this particular power source is used for illustrative purposes only.

In general overall concept, current driven automatic gain controlled electronic ballast system or ballast system 100 is provided to aid in the maximization of the efficiency of light output from gas discharge tubes 140 and 140' when taken with respect to the interrelated power input from power source 112. For purposes of this description, fluorescent gas discharge tubes 140 and 140' may be standard Philips TL 20w/54 type tubes. As will be seen in following paragraphs, current driven ballast system 100 provides for a substantially constant light output regardless of voltage variations by virtue of the output to gas discharge tubes 140 and 140' being responsive to a pulsating driving current as opposed to being responsive to an input voltage. Still further, ballast system 100 provides for automatic gain control eliminating the necessity for matching of the gain of transistor components within overall system 100.

Ballast system 100 still further provides for a frequency control mechanism utilizing the inductive characteristics of inverter transformer 178 allowing for frequency stabilization. This has the advantage of allowing system 100 to operate in a nominal manner without unwanted flicker when either of gas discharge tubes 140 or 140' are electrically deleted from system 100 in the operating mode.

Operational costs for extended operation lives of gas discharge tubes 140 and 140' are minimized through the extended higher efficiencies obtained by current driven automatic gain controlled electronic ballast system 100. Minimization of electrical components of ballast system 100 in combination with the simplicity of the circuitry has been found to increase the reliability of system 100 over prior art ballast systems. Increase of the reliability of ballast system 100 has been found to aid in maximizing the operational life of gas discharge tubes 140 and 140'.

Referring now to the FIGURE, electronic ballast system 100 includes filter circuit 111 which is coupled to power source 112 for establishing a substantially constant voltage and aids in suppressing harmonic frequencies generated by electronic ballast system 100. Ballast system 100 includes induction circuitry 115 electrically connected to filter circuit 111 for generating a predetermined voltage across gas discharge tubes 140 and 140' responsive to a pulsating driving current established by switching network 113. In order to generate a predetermined voltage across gas discharge tubes 140 and 140' responsive to the pulsating current established by switching network 113, induction circuitry 115 is coupled to filter circuit 111 and switching network 113.

Induction circuitry 115 includes automatic gain control circuit 117 for maintaining a predetermined gain value of switching network 113 to a predetermined gain level. Induction circuitry 115 further includes trigger winding 143 for generating a switching signal. Switching network 113 generates a pulsating driving current responsive to the switching signal generated in trigger winding 143.

As was previously described, power source 112 for purposes of illustration is designated as a 210–240 volt, 50 Hz. power source. However, power source 112 may be an AC power source of standard voltage, such as 120, 240, 270, or any acceptable standardized AC power voltage generated at frequencies approximating 50.0 or 60.0 Hz. In broader concept, power source 112 may be a DC power electrical source applied internal or external system 100 in a manner well-known in the art by removal of predetermined portions of the overall circuitry.

Power for system 100 is supplied by power source 112 to switch 114 which may be a standardized switch element such as a single pole, single throw switch mechanism, commercially available.

Power is input through power line 116 to rectification circuit 118 which provides for full wave rectification of power source AC voltage. Rectification circuit 118 may be a full wave bridge circuit, as is shown in the FIGURE. Full wave bridge circuit 118 is formed by diode elements 120, 122, 124 and 126 for providing rectification of AC voltage from power source 112. In the embodiment shown, diode elements 120–126 may be one of a number of standard diode elements, and in one form of ballast system 100, may have the standardized designation of 1N4005. Thus, as is seen, rectification circuit 118 is coupled in parallel relation to power source 112 through switch member 114.

Bridge circuit 118 provides an output pulsating DC voltage signal passing on output line 138, which pulsating signal is applied to filter network 111. Filter network 111 filters the aforementioned pulsating DC voltage passing from rectification circuit 118. Filter network 111 is electrically coupled to bridge circuit 118 by output line 138.

In order to provide for a substantially continuous smooth signal for operation of system 100, filter circuit 111 includes smoothing filter 136 used for averaging the pulsating DC voltage signal. Rectification bridge circuit 118 is coupled to ground 130 in order to be the return path for the DC supply for opposing ends of bridge circuit 118 providing DC power input to filter network 111.

Smoothing filter 136 of filter network 111 includes choke element 132 and shunt capacitor 134. Choke element 132 is coupled on a first end in series relation to rectification circuit 118 and additionally coupled to shunt capacitor 134 on an opposing end. Shunt capacitor 134 is connected in parallel relation with the overall output of filter network 111, as is shown. Shunt capacitor 134 is coupled on a first end to choke element 132 and to filter output line 141, as well as being coupled on an opposing end to DC return 130.

Series inductor or choke element 132 is coupled in series relation with full wave bridge circuit 118 and power input line 141. Choke or series inductor element 132 is also coupled on a first end to output line 138 and on a second end to shunt capacitor 134. In combination, shunt capacitor 134 with choke element 132 function to substantially average out the 100.0 Hz. pulsating DC voltage supplied by full wave bridge circuit 118. The combination of shunt capacitor 134 and choke element 132 additionally maintains the current draw by system 100 at an average value without creating an overall power factor which would be deleteriously leading or in the alternative, lagging. Such deleterious lead or lag of the power factor may be found where large inductances were used in the overall circuit, or in the alternative, where a large capacitance is used as the sole filtering mechanism for smoothing the pulsating DC voltage generated.

It is to be noted that in the event choke or series inductor element 132 were deleted from ballast system 100, shunt capacitor 134 would thus draw an increased current. This increased current is commonly referred to as a surge current and would be evident on each cycle as capacitor 134 began its charge. Through the incorporation of series inductor 132, the inductance stores energy during each cycle to supply current for initial charging of shunt capacitor 134 which thus provides the smooth average current as seen by power source 112.

In the embodiment herein shown, choke or series inductor element 132 may be an inductor having an approximate value of 860 millihenry. Shunt capacitor 134 may be a commercially available 100.0 microfarad, 250.0 volt capacitor.

Filter network 111 which is coupled to power source 112 includes correction circuit 119. Correction circuit 119 is composed of an electrical network of three capacitors and two resistors having predetermined values selected in a manner to allow tuning of the network in order to substantially reduce harmonic oscillations which might otherwise be coupled back to power source 112. The tuning of correction circuit 119 is designed in a manner to provide significant reduction in the amplitude of the first five harmonic frequencies coupled into the DC supply of electronic ballast system 100. It has been found that harmonic frequencies which are multiples of the initial five harmonic frequencies are similarly reduced, as is typical in filters of this type.

Correction circuit 119 further includes first RC circuit 121 which is coupled in parallel relation to the DC output of bridge rectifier circuit 118. First RC circuit 121 includes first capacitor 123 electrically coupled on a first end to rectifier output line 138 and on the opposing end to first series resistor 125. Series resistor 125 is connected in series relation to first capacitor 123 and ground 130, as is shown. Second capacitor 127 is coupled in parallel relation to the series combination of first capacitor 123 and first series resistor 125. For the embodiment shown in the FIGURE, first capacitor 123 may be approximately a 1.0 microfarad, 350.0 volt Mylar type capacitor. Second capacitor 127 may be a 0.5 microfarad, 350.0 volt Mylar type element with first series resistor 125 having an approximate value designation of 82.0 ohms, 1.0 watt resistor element.

In addition, correction circuit 119 further includes second RC circuit 129 having second capacitor 133 coupled in series relation to second resistor 131. Series combination of second capacitor 133 and second resistor 131 is connected in parallel relation to series inductor or choke element 132 in order to provide a low impedance path for any harmonic frequency signals to first RC circuit 119 which creates a low impedance path to ground 130.

A current signal passing through power input line 141 responsive to actuation of power source 112 is inserted to bias resistor 152 as well as to bias capacitor 154. Bias resistor 152 and bias capacitor 154 are connected in parallel relation each with respect to the other. The combination of bias resistor 152 and bias capacitor 154 are coupled to center tap line 160 of trigger control winding 143 of inverter transformer 178. As can be seen, trigger control winding 143 is coupled to both filter network 111 and switching circuit 113. Center tap line 160 provides a center tap to trigger control winding 143 and establishes a switching control signal having opposing polarity when taken with respect to the center tap. Bias resistor 152 and bias capacitor 154 are used to establish a bias voltage for initiation of an oscillation when electronic ballast system 100 is initially energized.

In the embodiment herein described, bias resistor 152 may have a value approximating $220.0 \times 10^3$ ohms and bias capacitor 154 may have an approximate value of 1.0 microfarads.

Current limiting resistor 156 and blocking diode 158 in series combination are coupled to center tap line 160. The series combination of current limiting resistor 156 and blocking diode element 158 provides for return to ground 130 for the trigger signal generated in trigger control winding 143 when electronic ballast system 100 has passed into an oscillation phase.

The bias circuitry for trigger control winding 143 includes bias resistor 152 as well as bias capacitor 154 coupled in parallel relation each with respect to the other. The parallel combination of elements 152 and 154 are coupled in series relation to the center tap of trigger control winding 143 through center tap line 160 and initiates the overall oscillation signal.

Although not important to the inventive concept as herein described, but provided for disclosure purposes, current limiting resistor 156 may have a value approximating 15.0 ohms with a dissipation range of approximately 1.0 watts. Blocking diode 158 may be a commercially available element having a common designation 1N4001, which is coupled to a first end of current limiting resistor 156 and on an opposing end to ground 130.

The above-referenced combination of elements provides for the initiation of the operation of electronic ballast system 100 when switch 114 is closed. Additionally, current limiting resistor 156 is coupled to center tap line 160 and further to blocking diode 158 in series relation to provide the return path for the trigger control signal subsequent to the initiation of oscillation of system 100.

Current driven gain controlled electronic ballast system 100 includes switching network 113 which is coupled to induction network 115. Switching network 113 includes a pair of transistors 170 and 170' connected in feedback relation to trigger control winding 143. Such coupling of transistors 170 and 170' to trigger control winding 143 allows switching a current signal responsive to a trigger signal produced.

Current enters trigger control winding 143 on center tap line 160 and is divided and flows through both first transistor line 162 and second transistor line 164 to bases 172 and 172', respectively, of transistors 170 and 170'. First and second transistors 170 and 170' may be of the NPN type which are commercially available, and may have a designation of MJE13005.

Current passing on first and second transistor lines 162 and 164 flow respectively to base elements 172 and 172'. Due to manufacturing considerations, one of first and second transistors 170 and 170' will have a higher gain than the other. Thus, the transistor 170 or 170' having the higher gain will be turned "on" or to a conducting state first. When either of first or second transistors 170 or 170' goes into a conducting mode, the other transistor 170 or 170' is held in a non-conducting state for the time interval during which the other transistor 170 or 170' is in the conducting or "on" state.

Assuming that second transistor 170' enters a conducting state, the voltage level of second transistor collector 174' is then brought into the neighborhood of second transistor emitter element 176' within approximately 1.0 volts.

As is seen in the schematic FIGURE, emitter element 176' is electrically coupled to inverter transformer gain control secondary winding 181. Transformer gain control secondary winding 181 is also coupled to ground 130. Thus, the current path for the base drive current is completed. Additionally, emitter element 176 of first transistor 170 is coupled to inverter transformer gain control secondary winding 180 which in a similar fashion as the case of secondary winding 181, is coupled to ground 130.

Induction circuitry 115 includes inverter transformer 178 which is connected to switching network 113 as has been previously described. Inverter transformer 178 includes a multi-tapped primary winding 182, as well as a multiplicity of secondary windings 202, 204, 206, trigger control winding 143, and inverter transformer gain control secondary windings 180 and 181. A pair of coupling capacitors 186 and 188 are connected in series relation to a respective tap of primary winding 182, as well as gas discharge tubes 140 and 140', respectively. Opposing ends of primary winding 182 are coupled to respective collector elements 174 and 174' of transistors 170 and 170' through lines 90 and 92.

Further included in induction circuit 115 is tuning capacitor 135 which is connected in parallel relation to primary winding 182. Tuning capacitor 135 is connected between collector elements 174 and 174' of transistors 170 and 170' for protection of transistors 170 and 170' from excessively high voltages which may be produced if one of gas discharge tubes 140 or 140' were electrically removed from ballast system 100. Tuning capacitor 135 changes the oscillation frequency in the event that one of gas discharge tubes 140 or 140' is removed from circuit 100. In this event, a lower voltage is induced in primary winding 182 which thus prevents damage to transistor elements 170 or 170'.

As will be described in following paragraphs, primary winding 182 of inverter transformer 178 is tapped in a manner to provide an auto-transformer configuration. Particularly, inverter transformer primary winding 182 is tapped by high voltage output line 137 and high voltage output line 139 on respective opposing ends of primary winding 182. With center tap line 141 referencing the primary winding 182 to the DC power supply, a step down auto-transformer configuration is provided in each half of primary winding 182. Each half of primary winding 182 then functions as a primary winding on alternate half cycles of the oscillation produced. Thus, in essence, primary winding 182 is electrically connected to DC power supply by center tap line 141. Each end of primary winding 182 is electrically coupled to a respective collector element 174 or 174' in switching circuit 113. High voltage output lines 137 and 139 electrically couple primary winding 182 to respective coupling capacitors 186 and 188.

Electronic ballast system 100 is current driven, which is in contradistinction to some prior art ballast systems where the saturating transformer is driven by the magnitude of a feedback voltage. In ballast system 100, during one half of the overall cycle, the collector current of first transistor 170 is in a feedback mode with inverter transformer 178. Current flows from power source 112 through center tap line 141 and then through one half of primary winding 182 to transistor collector line 190 and finally, to collector element 174 of transistor 170. Current passing through one half of primary winding 182 induces a voltage in trigger winding 143 which generates a base drive voltage. The base drive voltage is fed to base element 172 through line 162 which further reinforces the turning "on" of transistor 170. Base and collector currents pass through emitter element 176 through line 145 and then through gain control winding 180 and to ground 130.

In a similar manner, during alternate half cycles, collector current of second transistor 170' is in feedback coupling to inverter transformer 178 where again current flowing from the DC power source to center tap line 141 flows through the other half of primary winding 182 and then into collector line 192 and to collector element 174'.

This current flow in the alternate half cycle induces a voltage in trigger control winding 143 which has a polarity opposite to that which was generated in the previous half cycle due to the flow direction of the current in primary winding 182. Such flows through line 164 to base element 172' and then both base and collector currents then flow through collector element 176' through line 147' to gain control winding 181 and then to ground 130.

After oscillation begins, both the base voltages induced in trigger control winding 143 and the emitter voltages induced in gain control windings 180 and 181 are negative with respect to ground 130. However, the base voltage for the transistor 170 or 170' which is in the "on" state is less negative than its respective emitter voltage and therefore properly biased. This bias voltage is predetermined by the difference in turns in the respective windings 180 or 181 and 143 and therefore maintains a constant difference in potential which may occur between base 172 or 172' and emitter 176 or 176', respectively.

Collector current which flows through inverter transformer primary winding 182 during each half cycle generates a magnetic flux and induces voltages in all of the secondary windings of inverter transformer 178 while the current is increasing toward its steady state value. As the current approaches its maximum value its rate of change diminishes and thus the induced secondary voltages are correspondingly reduced. When the steady state current is reached, no transformer action takes place, and the transistor 170 or 170' which was in the "on" state no longer receives a base drive signal from trigger control winding 143 and therefore turns "off".

This actions terminates the current from flowing in primary winding 182 which has the effect of reversing the direction of the magnetic flux. This induces an opposite polarity voltage in trigger control winding 143 turning the transistor 170 or 170' into an "on" state if such was previously in the "off" state.

This then drives a current in an opposite direction through primary winding 182 and induces a trigger base drive signal. Once again, the collector current reaches a steady state value and transformer action stops and there is provided a repetitive process of oscillation whose frequency is determined by the inductance characteristics of inverter transformer 178. In this manner, the frequency of oscillation is determined by the characteristics of the core, the number of turns of the primary winding 182, and the current flowing through primary winding 182. Thus, oscillation frequency is much less dependent on supply voltage than that which is known in the prior art and produces a visible light output from discharge tubes 140 and 140' which is substantially constant and having minimal flicker even with large variations in supply voltage.

As is known from classical transistor theory, the emitter current of a transistor is the combination of the base current and the collector current. In the operation of ballast system 100, the base current component of the emitter current, with reference to transistor 170 when it is in the "on" state, flows from ground 130 into blocking diode 158 and through current limiting resistor 156 into tap line 160. Current flows through half of the winding of trigger control winding 143 to line 162 into base 172 and then through transistor emitter 176 into inverter transformer gain control secondary winding 180 and then to ground 130.

During a next consecutive half cycle, when second transistor 170' is in the "on" state, base current flows from ground 130 through blocking diode 158 and then through current limiting resistor 156 into center tap line 160 and trigger control winding 143.

Current in trigger control winding 143 then passes through line 164 to base 172' of second transistor 170' and through base emitter junction 172', 176' to second inverter transformer gain control winding 181 and then to ground 130. A complete path for the base current is thus established during each half cycle when system 100 is in oscillation.

The center tap of trigger control winding 143 is generally negative with respect to ground 130. However, winding 143 is positive with respect to the emitter voltage of either first or second transistors 170, 170'. In general, for an oscillatory signal to function in a proper mode, transistors used in prior art systems either had to be matched in a very close fashion each to the other, or the gains of the prior art transistors adjusted with external components such that they resulted in a matched gain. Such prior systems and methods added to the cost and complexity of prior art ballast systems which disadvantages have been obviated by system 100.

Current driven automatic gain controlled ballast system 100 provides for a unique method of achieving gain control without the requirement for matching of transistors or the adjustment of gains with external components. Ballast system 100 includes automatic gain controlled circuitry 117 which has a pair of windings 180 and 181 which are secondary windings of inverter transformer 178.

Inverter transformer gain control secondary windings 180 and 181 are coupled to emitter elements 176 and 176' of first and second transistors 170 and 170', respectively, as is shown in the Figure.

As will be detailed in following paragraphs, secondary windings 180 and 181 of automatic gain controlled circuit 117 are wound in a predetermined manner which is in the same direction as the primary winding 182, to provide a negative feedback voltage to each of emitter elements 176 and 176' of first and second transistors 170 and 170'. When collector current flows through first section 194 of primary winding 182, an induced voltage is generated in first inverter transformer gain control secondary winding 180 and is phased in a manner such that winding 180 negatively biases emitter 176 of first transistor 170 with respect to ground 130 to provide a negative feedback from first transistor 170.

This provides for a reference feedback voltage which is proportional to the current drawn through first section 194 of primary winding 182 which is the collector current of first transistor 170. Similarly, on alternate half cycles, the collector current of second transistor 170' flows to second section 198 of primary winding 182 which provides negative feedback for second transistor 170'.

Due to the fact that collector currents of first and second transistors 170 and 170' are a function of the base current and the gain of the respective transistors 170 or 170', and assuming that the base current of each transistor 170 and 170' are substantially equal, the difference in collector currents is proportional to the gain of each of transistors 170 and 170'.

By providing negative feedback voltage proportional to the collector current, the gain of each transistor 170 and 170' may be regulated to a predetermined value. Since the negative feedback limits the gain of each transistor 170 or 170' to a predetermined value which is less than the minimum gain of the transistor 170 or 170' as specified by the manufacturer, the gain of each transistor 170 or 170' as seen by the circuit, will be substantially the same.

Referring to the gain control, it is to be understood that the emitter currents flowing through gain control windings 180 and 181 effect the magnetization field within the core of inverter transformer 178. Obviously, this effect will either be additive or subtractive thus influencing the base drive voltage induced in trigger winding 143 by shifting the operating point on the hysteresis curve for the core material of inverter transformer 178. Thus, in the event that the transistor gain is above a desired value, the operating point on the hysteresis curve will decrease, resulting in a decrease of the base drive voltage induced in winding 143. In opposition, if the transistor gain is less than the desired value, the collector and emitter currents will be reduced and the operating point on the hysteresis curve will increase simultaneously increasing the base drive voltage in order to regulate system operation.

The base current flowing through current limiting resistor 156 and center tap line 160 follows a symmetrical path through each of the transistor circuits and therefore, the base currents for all intents and purposes, will be substantially identical, and since the gain is held at a predetermined value, the collector currents will also be substantially identical.

The apparent transistor gain will be substantially the same for both transistors 170 and 170' Additionally, the transistor gain is automatically controlled by the negative feedback generated in first inverter transformer gain control secondary winding 180 and second inverter gain control winding 181.

The respective polarities of the emitter feedback voltages appearing between first inverter transformer gain control winding 180 or second inverter transformer gain control winding 181 and ground 130 and the base drive voltages appearing between bases 172, 172' and ground 130 are negative. However, the relative magnitudes are such that the base voltage is positive with respect to the emitter feedback voltage during the conduction time of transistors 170 or 170'.

During the "off" time, both the base voltages and the emitter feedback voltage are positive with respect to ground potential, however, the difference in voltage between them is such that the bases 172 or 172' is biased negatively by approximately 2.5 volts with respect to its corresponding emitter 176 or 176'. This provides for a fast fall time and a short storage time, and therefore, a low dissipation is provided in transistors 170 and 170'. As the DC voltage applied to power line 141 increases with an increase in input AC voltage from power source 112, both of the base voltages and the emitter feedback voltage increase in magnitude, however, their relative difference remains constant at approximately 0.7 volts for the particular transistors and power output herein described.

Referring now in detail to inverter transformer 178, current flows through primary section 198 into collector 174' of transistor 170' which for the purposes of this current description, is in a conducting state. When switching takes place, transistor 170' goes to an "off" condition, or non-conducting state, which then causes a rapid change in current and produces a high voltage in primary section 198. The high voltage is then seen at second coupling capacitor 188 which is coupled by line 139 to primary section 198.

In a similar manner, a high voltage having opposing polarity is induced in primary section 194 similar to the voltage value of primary section 198. This is applied to gas discharge tube 140 and to first coupling capacitor 186 which is connected to first section 194 by coupling or tapping line 137.

Voltage induced in first section 194 of primary winding 182 when first transistor 170 is switched to an "off" state, is substantially equal in magnitude, but opposite in polarity, to that induced in second section 198 of primary winding 182 when second transistor 170' is switched to an "off" state.

Thus, an alternating voltage is generated at the predetermined frequency established by the saturation of inverter transformer 178. In a similar manner, the voltage induced in second section 198 of primary winding 182 is also alternating at the predetermined frequency and approximately 180° out-of-phase with a voltage generated in first section 194 of primary winding 182. This is due to the fact that each winding is on opposite sides of the center tap, and only one transistor 170 or 170' is in an "on" or "off" state during one time interval.

First and second coupling capacitors 186 and 188 are coupled to respective taps on inverter transformer primary winding 182 of inverter transformer 178. Capacitors 186 and 188 are also coupled to first filaments 142 and 142' of gas discharge tubes 140 and 140', respectively for discharging the induced voltage signal.

Secondary filament heater windings 202 and 206 are coupled in series relation to each of the first and second coupling capacitors 186 and 188 for discharging the induced voltage in primary sections 194 and 198 of primary winding 182 into gas discharge tubes 140 and 140'. As is clearly seen, secondary filament heater windings 202 and 204 of inverter transformer 178 are coupled to filaments 142 and 144 of gas discharge tube 140. In like manner, secondary filament heater windings 204 and 206 of inverter transformer 178 heat filaments 144' and 142' of gas discharge tube 140'.

The induced voltage which is discharged in fluorescent tubes 140 and 140' cause a current to flow from filaments 142 and 142' to filaments 144 and 144', respectively. Both filaments 144 and 144' are coupled to ground 130 through filament lead 208. Second filaments 144 and 144' of gas discharge tubes 140 and 140' are coupled in parallel each to the other through lines 208 and 210.

Secondary filament heater winding 204 is connected in parallel relation to both second filaments 144 and 144' of gas discharge tubes 140 and 140'. Similarly, filament heater secondary windings 202 and 206 are connected in parallel to first filaments 142 and 142', respectively. Thus, first filaments 142 and 142' are heated by filament heater windings 202 and 206 and second filaments 144 and 144' share heater current from heater filament secondary winding 204 which is coupled to ground 130 to provide a current path for the induced discharge current.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. A current driven gain controlled electronic ballast system having a power source for actuating at least one gas discharge tube, comprising:

(a) filter means connected to said power source for (1) establishing a substantially constant voltage signal, and, (2) suppressing harmonic frequencies generated by said electronic ballast system;

(b) induction means coupled to said filter means for generating a voltage across at least one of said gas discharge tubes responsive to a driving current, said induction means including automatic gain control means for maintaining said driving current at a predetermined value and having trigger means for generating a switching signal, said filter means including a correction network for substantially reducing harmonic frequencies generated by said induction means and smoothing filter means coupled in parallel relation to said correction network for maintaining said substantially constant voltage signal, said smoothing filter means including a series inductor coupled in series relation to said power source and said induction means; and, (c) switching means coupled to said induction means for establishing said driving current at a substantially constant and predetermined frequency responsive to said switching signal established by said trigger means, said driving current being passed through said induction means for generating said voltage across said gas discharge tube substantially indpendent of fluctuations in a voltage signal of said power source.

2. The electronic ballast system as recited in claim 1 wherein said smoothing filter means includes:

a shunt capacitor coupled to said series inductor and said power source, said shunt capacitor being coupled in parallel relation with an output of said filter means.

3. The electronic ballast system as recited in claim 2 where said correction network includes:

(a) a first resistor connected in series to a first capacitor having predetermined values for substantially reducing predetermined harmonic frequencies, said first series resistor and capacitor combination being coupled in parallel relation to said power source;

(b) a second capacitor having a predetermined value coupled in parallel relation to said first series resistor and capacitor combination; and, (c) a second resistor connected in series with a third capacitor to provide a low impedance path for predetermined harmonic frequencies, said second series resistor and capacitor combination being coupled in parallel relation to said series inductor of said smoothing filter means.

4. The electronic ballast system as recited in claim 1 where said switching means includes a pair of transistors defining a first transistor and a second transistor, said pair of transistors being coupled to said induction means.

5. The electronic ballast system as recited in claim 4 where each of said first and second transistors have a base element, a collector element, and an emitter element, each of said emitter elements of said first and second transistors being connected to said automatic gain control means.

6. The electronic ballast system as recited in claim 1 where said induction means includes:

(a) an inverter transformer coupled to said switching means and said filter means, said inverter transformer having a tapped pair of primary windings and a multiplicity of secondary windings;

(b) a pair of coupling capacitors, each of said coupling capacitors connected in series relation to a tapped portion of one of said respective primary windings and one of said gas discharge tubes; and, (c) a tuning capacitor coupled between collector elements of a pair of first and second transistors respectively; said tuning capacitor for preventing generation of excessive voltages when one of said gas discharge tubes is removed from the circuit.

7. The electronic ballast system as recited in claim 6 where said primary windings of said inverter transformer are tapped in a manner to provide a step down auto-transformer configuration.

8. The electronic ballast system as recited in claim 6 where one of said pair of said primary windings of said inverter transformer passes a current on alternate half cycles of said predetermined frequency relative to the other of said primary windings of said inverter transformer.

9. The electronic ballast system as recited in claim 6 where said switching means includes said first and second transistors, each of said first and second transistors having a respective base element, a collector element and an emitter element, said collector elements of said first and second transistors being coupled to a respective first end of one of said primary windings of said inverter transformer.

10. The electronic ballast system as recited in claim 9 where said first and second transistor base elements are coupled to one of said multiplicity of said secondary windings of said inverter transformer.

11. The electronic ballast system as recited in claim 10 where said coupled secondary winding is connected on opposing ends thereof to said transistor base elements for establishing a trigger signal.

12. The electronic ballast system as recited in claim 11 where said coupled secondary winding is center tapped, said center tap being coupled to said filter means.

13. The electronic ballast system as recited in claim 11 where said secondary winding is wound in the same direction as said primary winding.

14. The electronic ballast system as recited in claim 6 where each of said primary windings of said inverter transformer have a second end, said second ends of said primary windings being coupled to said filter means.

15. The electronic ballast system as recited in claim 14 where each of said pair of coupling capacitors have a predetermined capacitive value for discharging said voltage from one of said taps of said primary windings of said inverter transformer across a respective one of said gas discharge tubes.

16. The electronic ballast system as recited in claim 6 where said inverter transformer is a ferrite core transformer.

17. The electronic ballast system as recited in claim 9 where said automatic gain control means is comprised of one pair of said multiplicity of secondary windings of said inverter transformer.

18. The electronic ballast system as recited in claim 17 where one of said pair of secondary windings comprising said automatic gain control means is coupled to said emitter element of said first transistor and said other of said secondary windings is coupled to said emitter element of said second transistor.

19. The electronic ballast system as recited in claim 18 where said pair of secondary windings of said automatic gain control means are wound in a predetermined manner to provide a negative feedback voltage to each of said emitter elements of said first and second transistors.

20. The electronic ballast system as recited in claim 19 where said pair of secondary windings are wound in the same direction as said primary windings.

21. The electronic ballast system as recited in claim 18 where said pair of secondary windings of said automatic gain control means are wound in a predetermined manner for shifting the operating point on the hysteresis curve of said inverter transformer to regulate the gain of said first and second transistors.

22. The electronic ballast system as recited in claim 21 where said pair of secondary windings are wound in the same direction as said primary windings.

23. The electronic ballast system as recited in claim 6 where at least two of said inverter transformer secondary windings are connected to opposing filaments of at least one of said gas discharge tubes.

24. The electronic ballast system as recited in claim 1 where said power source is an AC power source.

25. The electronic ballast system as recited in claim 24 including rectification means for providing full wave rectification of said power source AC voltage, said rectification means being connected to said AC power source and said filter means.

26. The electronic ballast system as recited in claim 25 where said rectification means includes a full wave bridge circuit.

27. The electronic ballast system as recited in claim 25 including secondary filter means for filtering a pulsating DC voltage from said rectification means, said filter secondary means being coupled to said rectification means.

* * * * *